US005392547A

United States Patent [19]

Mason

[11] Patent Number: 5,392,547

[45] Date of Patent: Feb. 28, 1995

[54] SHELF MOLDING FOR DISPLAYING PRICE AND INFORMATION TICKETS

[75] Inventor: Joseph E. Mason, Huntington, N.Y.

[73] Assignee: New Dimensions Research Corporation, Melville, N.Y.

[21] Appl. No.: 125,870

[22] Filed: Sep. 24, 1993

[51] Int. Cl.[6] ..... G09F 3/20

[52] U.S. Cl. ..... 40/642; 40/5; 40/653

[58] Field of Search ..... 40/5, 642, 647, 649, 40/650, 653; 24/543

[56] References Cited

U.S. PATENT DOCUMENTS

| | | | |
|---|---|---|---|
| 1,600,684 | 9/1926 | McGibbon | 24/543 |
| 2,532,028 | 11/1950 | Mapson et al. . | |
| 3,016,638 | 1/1962 | Singer . | |
| 3,320,690 | 5/1967 | Forsburg | 40/650 |
| 3,337,977 | 8/1967 | Sobesky | 40/650 |
| 3,889,408 | 6/1975 | Offner | 40/642 |
| 4,334,372 | 6/1982 | Colmar . | |
| 5,109,576 | 5/1992 | Teekell et al. | 24/543 X |
| 5,120,941 | 6/1992 | Reilley et al. | 40/642 X |

FOREIGN PATENT DOCUMENTS

| | | | |
|---|---|---|---|
| 2060075 | 10/1992 | Canada | 40/647 |
| 0012993 | 7/1980 | European Pat. Off. | 40/647 |
| 3515474 | 10/1986 | Germany | 40/642 |

*Primary Examiner*—Kenneth J. Dorner
*Assistant Examiner*—Joanne Silbermann
*Attorney, Agent, or Firm*—Salter & Michaelson

[57] ABSTRACT

A retail shelf molding includes a rear wall having a channel for holding information or inventory tickets and a front wall having an outwardly facing channel for displaying price tickets. The shelf molding is preferably integrally formed as an extrusion wherein the rear wall and the front wall are connected by a living hinge. The living hinge is located at the bottom edges of the front and rear walls so that they hingeably open from the top edge.

7 Claims, 2 Drawing Sheets

SHELF MOLDING FOR DISPLAYING PRICE AND INFORMATION TICKETS

BACKGROUND AND SUMMARY OF THE INVENTION

The instant invention relates to display devices and more particularly to a molding for displaying price and information tickets on retail shelving.

It is known in the art that it is highly desirable to display price tickets for retail items on shelving spaces immediately adjacent to such items. In this regard, a variety of shelf moldings for price tickets have heretofore been known in the art. For example, the U.S. Patents to Mapson et al No. 2,532,028; Singer No. 3,016,638; Forsberg No. 3,320,690 and Colmar 4,334,372 are illustrative of such display devices.

The patent to Mapson discloses a pivoting shelf molding comprising a hinge leaf and a price tag molding. The top edge of the molding is hingeably connected to the top edge of the hinge leaf and the body portion of the hinge leaf is mounted to the face of the shelving. In this manner, the price tag molding hingeably pivots at its upper edge. Price tags are mountable in the molding and are slidable along the length thereof.

The patent to Singer concerns an adjustable price tag mount in which the price tag may be changed without removing the tag from the display. The price tag used in this display comprises a continuous strip of flexible tape which is imprinted with a plurality of consecutive numbers. The tape is contained in a housing which has a window through which the tape is visible. Adjustment of the price tag is effected by sliding the tape within the housing. In addition, the housing is slidable along the length of the display.

The patent to Forsberg discloses a transparent insert for holding price tickets in a conventional shelf molding. The price ticket is received in the insert, and the insert is snap received into the shelf molding. The insert enables a plurality of different size price tickets to be mounted in the same size molding, and further prevents dust and dirt from building up inside the bottom lip of the molding.

The patent to Colmar discloses a price display device wherein the figures to be displayed are contained on a continuous strip of folded panels. The panels are received in adjacent channels in the display. In order to change the figures, the panels are folded over and received under the lip of the channel.

While the above described devices are effective for displaying price tickets, it has been found that it is also highly desirable to be able to store information and/or inventory code tickets adjacent to retail items so that store personnel have easy access to such information. It is preferable that such information and inventory tickets would not be visible to retail customers but would nevertheless be readily available to store employees.

The instant invention provides a shelf molding having an inner channel for holding product information and/or inventory tickets and an outer channel which hingeably closes over the inner channel for displaying price tickets. The shelf molding is preferably integrally formed as an extrusion and it comprises a rear wall having an outwardly facing channel, a front wall having an outwardly facing channel and a living hinge connecting the front and rear walls at their bottom edges. The front wall is hingeably movable between an open position wherein the channel on the rear wall is readily viewable and a closed position wherein the front wall overlies the rear wall so that the rear wall is shielded from view and the channel on the front wall is readily viewable. The top edges of the front and rear walls include an inter-locking lip arrangement which releasably maintains the front wall in the closed position. The bottom hinge arrangement enables the molding to be hingeably opened from the top so that the information tickets in the channel on the rear wall are readily viewable only when the front wall is in the open position.

The shelf molding further includes a plurality of different thickness spacer elements which enable the molding to be mounted on various types of existing retail shelves.

Accordingly, it is an object of the instant invention to provide a shelf molding having an inner channel for holding product information and/or inventory tickets and an outer channel for displaying price tickets.

It is another object to provide a shelf molding having an outer channel which hingeably closes over an inner channel.

It is yet another object to provide a shelf molding which is integrally formed as an extrusion.

It is still another object to provide a shelf molding which is adaptable for mounting on a plurality of different types of retail shelving.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
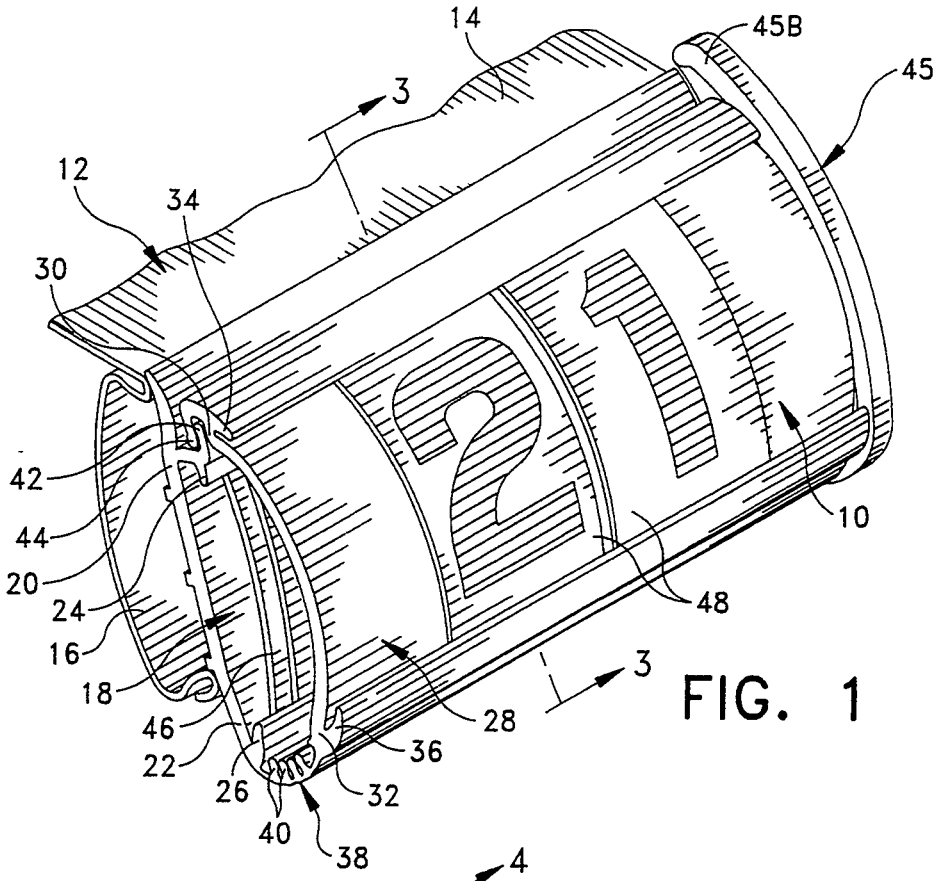
FIG. 1 is a perspective view of the instant shelf molding with the front wall in the closed position.
Figure 2:
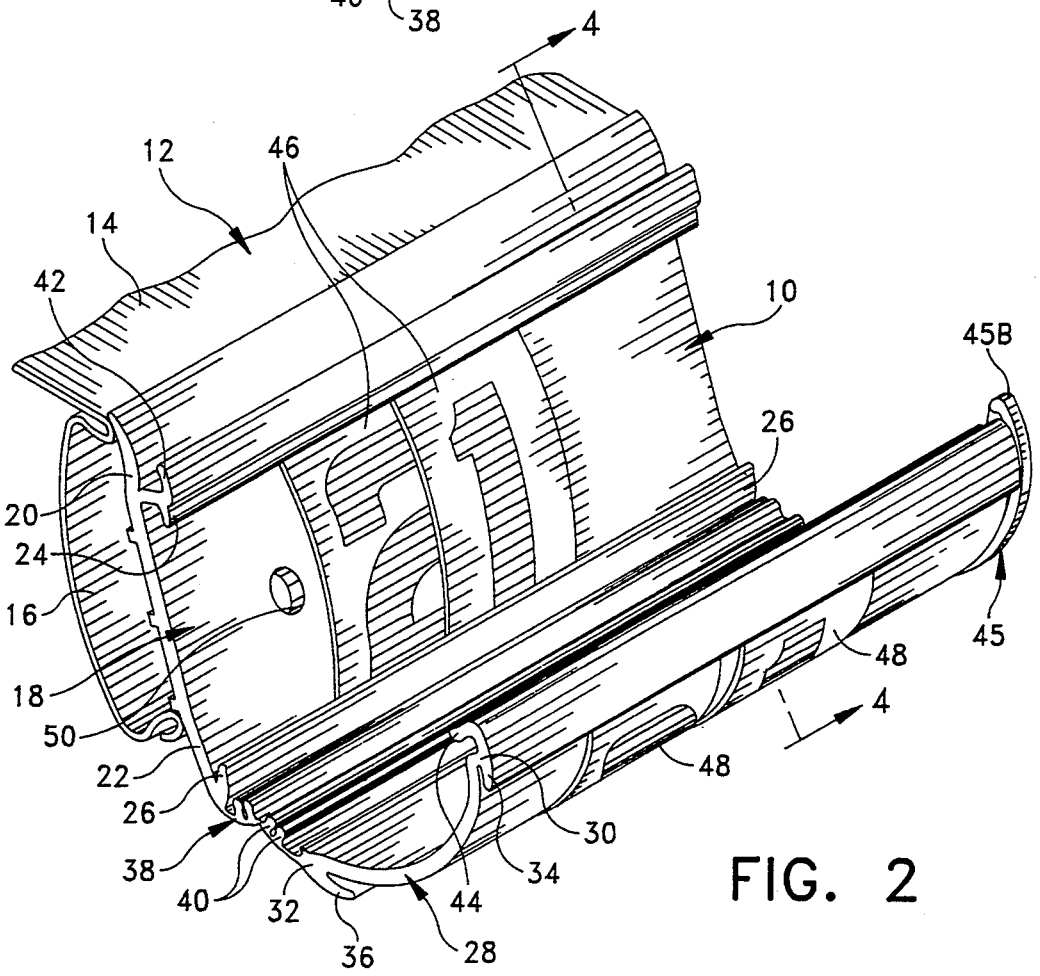
FIG. 2 is a perspective view thereof with the front wall in the open position.

Referring now to the drawings, the instant shelf molding is illustrated and generally indicated at 10 in FIGS. 1 through 4. As will hereinafter be more fully described, the shelf molding 10 is mountable along the length of a retail shelf 12 wherein it is operative for holding a plurality of product information or inventory tickets in an inner channel and it is further operative for displaying price tickets in an outer channel.

A conventional retail shelf 12, such as a Schultz type shelf as illustrated in FIGS. 1 through 4, typically comprises a horizontal shelf portion 14 for receiving items thereon and a downwardly extending flange portion 16 which is adapted for receiving price tickets therein.

Figure 3:
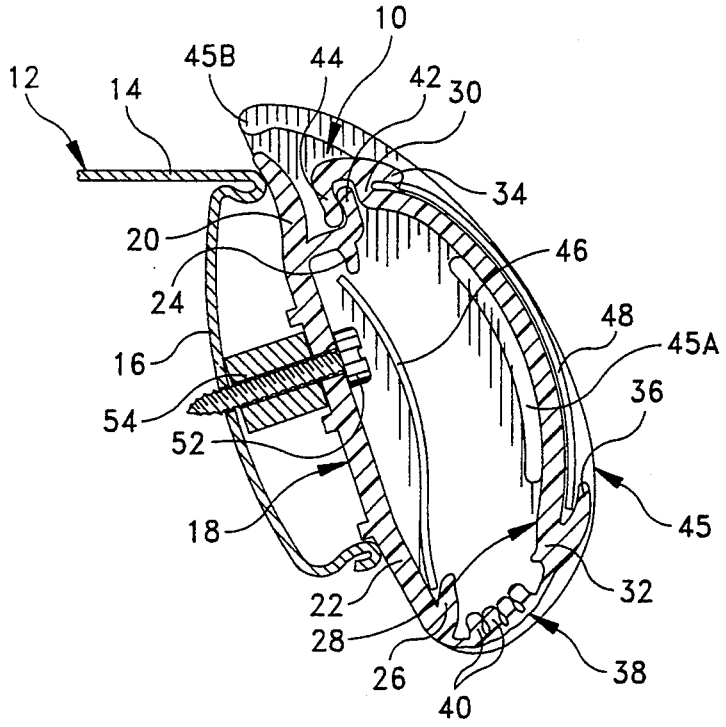
FIG. 3 is a cross-sectional view thereof taken along line 3—3 in FIG. 1.
Figure 4:
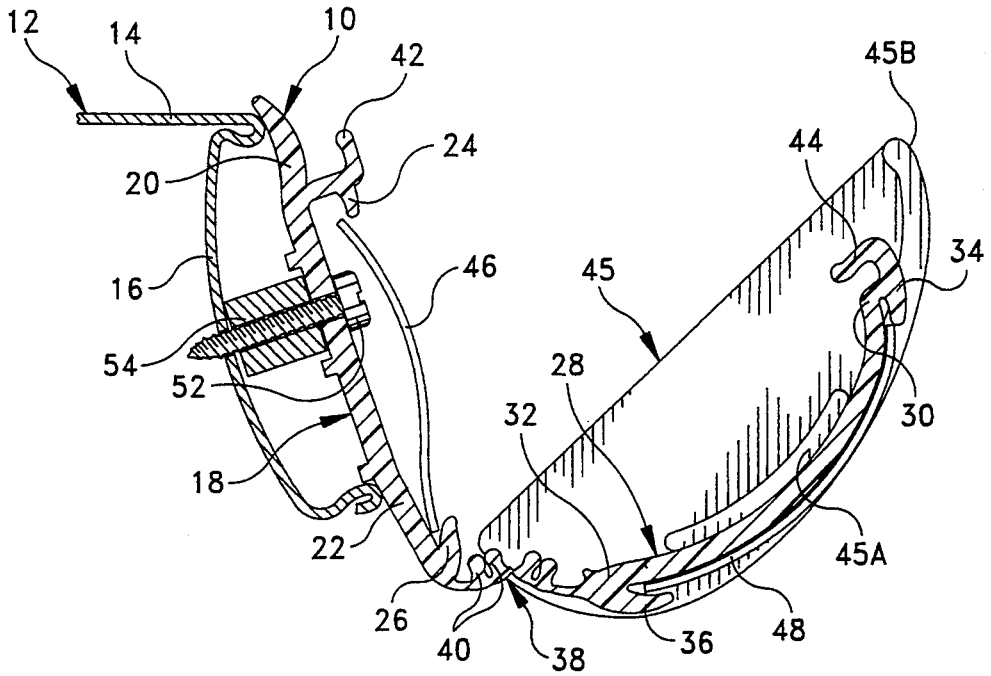
FIG. 4 is another cross-sectional view thereof taken along line 4—4 in FIG. 2.

The shelf molding 10 is preferably integrally formed as an extrusion from a rigid, yet resilient plastic. The plastic is preferably opaque in order to prevent customers from viewing information tickets which may be stored inside the molding 10. The molding 10 preferably comprises a substantially flat rear wall generally indicated at 18 having upper and lower edges 20 and 22 respectively, a downwardly extending lip 24 at the upper edge 20, and an upwardly extending lip 26 at the lower edge 22. The molding 10 further comprises an arcuate front wall generally indicated at 28 having upper and lower edges 30 and 32 respectively, a downwardly extending lip 34 at the upper edge 30, and an upwardly extending lip 36 at the lower edge 32. The lower edges 22 and 32 of the front and rear walls 18 and 28 are hingeably connected by a living hinge generally indicated at 38. The living hinge 38 comprises a plurality of longitudinal ridges 40 which causes the hinge 38 to bend in a continuous curve. It can therefore be seen that the front wall 28 and the rear wall 18 hingeably open at their top edges 20 and 30 respectively, and that the front wall 28 is hingeably movable between an open position (FIGS. 2 and 4) wherein the rear wall 18 is exposed, and a closed position (FIGS. 1 and 3) wherein the front wall 28 overlies the rear wall 18. In order to maintain the front wall 28 in the closed position, the front and rear walls 18 and 28 are provided with integral closure means comprising an upwardly extending lip 42 at the upper edge 20 of the rear wall 18, and a downwardly extending lip 44 at the upper edge 30 of the front wall 28. When the front wall 28 is moved to the closed position, the downwardly extending lip 44 is snap-received over the upwardly extending lip 42 as illustrated in FIGS. 1 and 3. In this connection, it is pointed out that the living hinge 38 effectively creates a C-spring with the front wall 28 and gives an effective locking action for the closure means.

In order to separate the front wall 28 and rear wall 18 after closure, the molding 10 is provided with an end cap 45. A flange 45A on the end cap 45 is attached to the rear surface of the front wall 28 by any suitable means, such as by an epoxy adhesive, and a tip portion 45B of the end cap 45 extends upwardly, slightly above the closure means. The tip 45B functions as a lever arm to facilitate separation of the front and rear walls 28 and 18, respectively. When mounted on a shelving 12, the molding 10 may be opened by grasping the top portion 45B of the end cap 45 and pulling forwardly, wherein the downwardly extending lip 44 on the front wall 28 becomes disengaged from the upwardly extending tip 42 on the rear wall 18.

The downwardly and upwardly extending lips 24 and 26 respectively cooperate with the rear wall 18 to form an inner channel which is operative for frictionally receiving flexible information or inventory tickets 46. In a similar manner, the downwardly and upwardly extending lips 34 and 36 respectively cooperate with the front wall 28 to form an outer channel which is operative for receiving flexible price tickets 48. It is pointed out that both the information tickets 46 and the price tickets 48 are slidably movable along the length of the molding 10 so that they may be easily located adjacent to the appropriate merchandise. It is also pointed out that when the front wall 28 is closed over the rear wall 18, the inner channel (rear wall 18) is hidden from view and the outer channel (front wall 28) is readily viewable for retail customers. However, when the front wall is moved to the open position by store personnel (FIG. 2), the inner channel is exposed so that store personnel may quickly obtain inventory codes or other information relating to the products which may be located in that particular shelving area.

In order that the shelf molding 10 may be attached to existing retail shelving 12, the rear wall 18 is provided with a plurality of apertures 50 (FIG. 1) through which self-tapping screws 52 (FIGS. 3 and 4) are extended. In this connection, the self-tapping screws 52 extend through corresponding apertures 54 in the downwardly extending flange 16 of the shelving 12 to attach the molding. The molding 10 is further provided with a plurality of different thickness spacer elements 54 which are operative for bridging various width openings between the rear wall 18 of the molding 10 and the flange 16 of the shelving 12 so as to prevent the rear wall 18 from bending inwardly when installed. For example, in FIGS. 3 and 4, the self-tapping screws 52 extends through the rear wall 18 of the molding 10, through a spacer 54 and then through the downwardly extending wall 16 of the shelf 12. The spacer elements 54 still further operate to distribute the weight-bearing area of the self-tapping screws 52 so that the shelf molding 10 is more securely mounted to the shelf 12. In this regard, the shelf molding 10 will not be easily dislodged from its mounted position.

It is seen therefore that the instant invention provides an effective shelf molding 10 for displaying both price tickets 48 for use by retail customers and information tickets 46 for use by store personnel. The shelf molding 10 is formed as an integral extrusion and it includes a rear wall 18 having an outwardly facing channel portion for displaying the information tickets 46, and a front wall 28 also having an outwardly facing channel portion for displaying price tickets 48. The front wall and the rear wall are connected at their lower edges by a living hinge so that the front wall hingeably opens its top edge. The bottom hinge arrangement permits the inner information tickets to be easily viewed when the front wall is moved to the open position. For these reasons, the shelf molding 10 of the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A shelf molding comprising:

A rear wall having upper and lower edges, a downwardly extending lip at said upper edge and an upwardly extending lip at said lower edge;

a front wall having upper and lower edges, a downwardly extending lip at said upper edge, and an upwardly extending lip at said lower edge;

hinge means connecting the lower edge of said rear wall and the lower edge of said front wall, said front wall being hingeably movable between an open position wherein said rear wall is exposed for viewing and a closed position wherein said front wall overlies said rear wall; and closure means for releasably maintaining said front wall in said closed position, said closure means comprising an upwardly extending lip at said upper edge of said rear wall which interlocks with said downwardly extending lip when said front wall is moved to said closed position.

2. The shelf molding of claim 1 further comprising mounting means for mounting said rear wall to a length of shelving.

3. In the shelf molding of claim 2, said mounting means comprising a plurality of apertures in said rear wall and a plurality of fastener elements extending through said apertures.

4. The shelf molding of claim 3 further comprising a plurality of spacing elements which are received between the rear wall of said molding and said length of shelving, said fastener elements extending through said spacing elements and being attached to said length of shelving.

5. The shelf molding of claim 1 comprising an integrally extruded plastic material.

6. In the shelf molding of claim 1, said living hinge comprising a plurality of longitudinal ridges.

7. The shelf molding of claim 1, further including an end cap connected to said shelf molding having a tip portion which extends upwardly above the upper edge of said front wall.

* * * * *